US008307886B2

(12) United States Patent
Nitta et al.

(10) Patent No.: US 8,307,886 B2
(45) Date of Patent: Nov. 13, 2012

(54) HEAT EXCHANGING DEVICE AND METHOD OF MAKING SAME

(75) Inventors: Minoru Nitta, Upland, CA (US); Takeyoshi Nitta, Upland, CA (US)

(73) Assignee: Mikutay Corporation, Upland, CA (US)

( * ) Notice: Subject to any disclaimer, the term of this patent is extended or adjusted under 35 U.S.C. 154(b) by 38 days.

(21) Appl. No.: 12/856,179

(22) Filed: Aug. 13, 2010

(65) Prior Publication Data

US 2010/0300668 A1 Dec. 2, 2010

Related U.S. Application Data

(63) Continuation-in-part of application No. 12/148,655, filed on Apr. 21, 2008, now Pat. No. 7,987,900.

(51) Int. Cl.
*F28F 13/12* (2006.01)
*F28F 9/22* (2006.01)
*F28F 1/40* (2006.01)

(52) U.S. Cl. ..... 165/109.1; 165/144; 165/174; 165/177; 29/890.053

(58) Field of Classification Search ..... 29/890.053
See application file for complete search history.

(56) References Cited

U.S. PATENT DOCUMENTS

| | | | | |
|---|---|---|---|---|
| 141,133 | A | 7/1873 | Gee | |
| 265,279 | A | 10/1882 | Pierce et al. | |
| 709,006 | A | 9/1902 | Geurink | |
| 1,327,165 | A | 1/1920 | Merritt | |
| 1,656,790 | A | 1/1928 | Heijkenskjold | |
| 1,666,660 | A | 4/1928 | Makin | |
| 1,844,308 | A | 2/1932 | Armacost | |
| 1,946,234 | A | 2/1934 | Price | |
| 2,030,734 | A | 2/1936 | Berd | |
| 2,274,965 | A | 3/1942 | Kito | |
| 2,752,127 | A | 6/1956 | Campe et al. | |
| 3,099,315 | A | 7/1963 | Loehr | |
| 3,976,128 | A | 8/1976 | Patel | |
| 4,332,293 | A | 6/1982 | Hiramatsu | |
| 4,981,170 | A | 1/1991 | Dierbeck | |
| 5,137,080 | A * | 8/1992 | Haasch et al. | 165/144 |
| 5,505,252 | A | 4/1996 | Mano | |

(Continued)

FOREIGN PATENT DOCUMENTS

DE 2249117 A1 4/1974

(Continued)

OTHER PUBLICATIONS

Japanese Patent Office, "Notification of Reasons for Rejection" re: Patent Application Serial No. 2011-506261, Drafting Date: May 24, 2012, 3 pages.

(Continued)

*Primary Examiner* — Leonard R Leo

(57) ABSTRACT

A heat exchanging device includes first and second disk members coupled together to form a disk unit having a chamber. The first disk member has an inlet and the second disk member has an outlet. A medium directing member is disposed within the disk unit. A first end of the medium directing member has a first channel formed at an angle to direct heat exchange media flowing in from the inlet to the chamber, and a second end of the medium directing member has a second channel formed at an angle to direct the heat exchange media out of the chamber through the outlet. A plurality of disk units are coupled together in a row. Multiple rows of the heat exchanging devices may be disposed between manifolds.

18 Claims, 5 Drawing Sheets

U.S. PATENT DOCUMENTS

| | | | | |
|---|---|---|---|---|
| 5,538,077 | A * | 7/1996 | So et al. | 165/153 |
| 6,612,031 | B2 | 9/2003 | Rhodes | |
| 2007/0215330 | A1 | 9/2007 | Umetsu | |
| 2009/0260788 | A1 | 10/2009 | Nitta | |

FOREIGN PATENT DOCUMENTS

| | | | |
|---|---|---|---|
| DE | 3300929 | A1 | 7/1984 |
| FR | 2898405 | A1 | 9/2007 |
| JP | S50-11257 | | 4/1975 |
| JP | S56-068795 | | 6/1981 |
| JP | 56154275 | | 11/1981 |
| JP | S58-154393 | | 10/1983 |
| JP | H10-306995 | A | 11/1998 |
| JP | 11287571 | | 10/1999 |
| JP | 11287571 | A | 10/1999 |
| JP | 2006-336902 | A | 12/2006 |
| SU | 1814716 | A3 | 5/1993 |
| WO | WO 03/056267 | A1 | 7/2003 |
| WO | 2008/13965 | A1 | 11/2008 |

OTHER PUBLICATIONS

Korean Intellectual Property Office, "Notice of Preliminary Rejection" re: Patent Application Serial No. 10-2010-7025911, Date: Jun. 1, 2012, 4 pages.

Patent Office of the Russian Federation, "Decision on Grant, A Patent for Invention, Report on Results of Examination" re: Patent Application Serial No. 2010147367/06(068438); Date: Jul. 17, 2012, 13 pages.

State Intellectual Property Office of the People's Republic of China, "Notice of Second Office Action" Patent Application No. 200980114176.7 of Mikutay Corporation; Issue Date: Aug. 16, 2012; 27 pages.

* cited by examiner

HEAT EXCHANGING DEVICE AND METHOD OF MAKING SAME

CROSS-REFERENCE TO RELATED APPLICATION

This application is a continuation-in-part of U.S. patent application Ser. No. 12/148,655, filed Apr. 21, 2008, now U.S. Pat. No. 7,987,900, the entire content of which is incorporated herein by reference.

BACKGROUND OF THE INVENTION

1. Field of Invention

The present invention relates to heat exchangers, specifically to a disk type heat exchanger unit with plurality of tubes and disk units for transporting heat exchange media within.

2. Discussion of the Related Art

Heat exchangers are used in various applications where heat from one media is desired to be transported to another media. Typical heat exchangers are made of tubes with plurality of fin attachments on surface of tubes. Heat exchange media is transported through tubes, carrying heat within the media. The heat transported through tubes by means of heat exchange media is then transported within a tube and fin structure, as the heat exchange media flow through tubes. The tube and fin structure is surrounded by another heat exchange media, absorbing away heat from the tube and fin structure. The efficiency of a heat exchanger is dictated by the ratio of volumetric capacity of tubes to the overall surface area of tubes and fins. Typical application of this type of high performance heat exchangers are condensers and evaporators for use in commercial and residential air conditioner units. Variants of this type of heat exchangers are commonly utilized in commercial and automotive applications as oil coolers, evaporators, condensers, heater cores, and radiators.

Efforts to enhance performance of heat exchangers is generally achieved by creating complex fin structures that have myriad bends and folds to create as much surface area within a given confine. Fins effectively increase surface area of tubes. In another effort to improve the performance, fins in addition to bends and folds may have plurality of louver features created on surface of fins. High performance heat exchangers are generally utilized where space is restricted, thus achieving higher performance with heat exchangers of smaller footprint. Enhancement efforts by means of utilizing complex fin structures may improve performance of heat exchangers, but potential additional manufacturing processes may adversely affect a total manufacturing cost of heat exchangers.

In another embodiment of this effort, instead of round tubes, flat tubes are made with plurality of small diameter holes. Generally of aluminum extrusion, intricate tubes are made with plurality of small diameter holes. To further improve performance of heat exchangers, thickness of a material used to create fins and tubes may be made thinner. By making the thickness of a material thinner, performance of a heat exchangers may be improved by shortening a distance that heat has to travel within walls of tubes and fins structures, improving heat conduction efficiency. Thinning a material has the adverse effect of weakening a structure, however. Also, in an application such as automobiles where potential for debris hitting a heat exchanger surface is high, having a weak structure is not favorable, as a heat exchanger may be easily damaged, or worse having a puncture within tubes, causing heat exchange media within to leak out, rendering the heat exchanger useless. A manufacturing process of assembling together various heat exchanger components may be complicated as well, when components utilized are manufactured of thin walled tubes and fins. Complication of manufacturing method typically has an adverse effect on the manufacturing cost, generally raising cost of individual components. Fragile components may also complicate handling of components during an assembly stage, as well as requiring stricter tolerance components as well as assembly machines capable of meeting strict tolerances, all of these factors typically resulting in higher component costs and assembly costs.

A variation on a tube-based heat exchanger involves stacking flat, ribbed plates. When said flat, ribbed plates are stacked upon each other, said plates create chambers for transferring heat exchanging media. In essence, this type of heat exchanger performs substantially the same function as tube-and-fin type heat exchangers, but is fabricated differently. This type of heat exchanger is commonly implemented by contemporary evaporators for automotive applications.

A first prior art example of a conventional tube and fin heat exchanger is described in Rhodes, U.S. Pat. No. 6,612,031. In this patent, an aluminum tube with multiple partitions within a tube is first extruded, then cut into desired length. These tubes are then combined with additional fins, as tube surface alone is often insufficient and incapable of dissipating heat carried by a heat exchange media. Fins are sandwiched in between each row of tubes comprising a core of a heat exchanger. There are certain drawbacks to this type of heat exchanger cores. First, and foremost, tube extrusions with intricate inner partitions are very difficult to manufacture, requiring precision instruments to obtain a desired shape such as aluminum extrusion machines. An aluminum extrusion machine capable of manufacturing intricate extrusions are often very expensive machines, as well as being notoriously high in operating costs. The more intricate the extrusion shape, an aluminum extrusion machine's extrusion speed has to be reduced not only to obtained a desired shape, but also to protect an extrusion die, as complex extrusion shape causes the extrusion die to be very delicate, prone to damage. Due to the complex nature of extrusion machines, as well as slow operation and delicate extrusion dies that often break during operation, extruded tubes are sold at a relatively high cost, not to mention that there are only a handful of companies with extrusion machines capable of manufacturing intricate tube designs driving up cost of tubes. With tube and fin heat exchanger design, various components are combined together to form a heat exchanger core. These components are typically not designed to maintain its position in relation to each component pursuant to a heat exchanger design parameters during an assembly process, prior to a brazing process which would braze together all components to form a unitary unit. As such, specialized assembly fixtures are often necessary during a manufacturing process to keep the parts together. As a fixture is critical in yielding a good working part, fixtures are often designed to close tolerances resulting in high cost. Also, as a fixture is needed for each heat exchanger assembled at a time, in a large manufacturing operations, where high volume of heat exchangers have to be manufactured at a time, a significant investment has to be made in fixtures, to have on hand enough sufficient quantity of assembly fixtures to support an assembly line. All these investments result in added costs to the manufacturing cost of tube and fin heat exchangers.

Fins utilized are generally of complicated design as described in a second prior art example of a conventional tube and fin heat exchanger in Hiramatsu, U.S. Pat. No. 4,332,293. In this patent, an aluminum tube is combined with corrugated fins to comprise a heat exchanger core. Fins are generally added to tubes to enhance the heat exchange efficiency, as tube surface alone is generally insufficient to handle the necessary heat conduction. Fins discussed in this patent are corrugated to enhance performance of a heat exchanger. Corrugation is added to fins, as flat sheeted fins often do not yield a desired performance expectation. Therefore, fins are generally fabricated with corrugation feature at an additional fabrication cost and manufacturing processes.

A third prior art example of a conventional heat exchanger is commonly known as plate and fin heat exchangers described in Patel, U.S. Pat. No. 3,976,128. In this patent, instead of extruded tubes, individual tubes comprise of two formed plate halves, split along the long axis of the tube. By eliminating usage of extruded aluminum tubes, and by creating individual tubes by combining two formed plates, the main benefit is the cost savings, as formed plates are often less expensive to manufacture in comparison to aluminum extrusion tubes. As with tube and fin heat exchangers, however, tubes of plate and fin heat exchangers often do not have sufficient surface area in relation to the volumetric capacity of a tube assembly to dissipate heat carried by heat exchange media within, rendering a heat exchanger useless without additional surface area addition. In order to enhance performance of plate and fin heat exchangers, fin structures are sandwiched in between each row of formed plate tube structures to obtain added surface area to dissipate heat. There are certain drawbacks to this type of heat exchangers. First, and foremost, although the cost of components may be saved in comparison to extruded tubes, an assembly process of plate and fin heat exchangers remains similar to tube and fin heat exchangers, resulting in a complex assembly process often requiring a specialized assembly fixture to secure all components together until components are brazed together to form a unitary unit in a brazing process. The use of assembly fixture is often vital, driving up initial investment cost necessary to manufacture plate and fin heat exchangers, as significant investment has to be made in assembly fixtures for manufacture of specific configuration heat exchanger cores. Additionally, unlike extruded aluminum tubes, a plate and fin heat exchanger can not be created with too much intricate details, as an assembly of two plate halves are often imprecise, and if a plate design is too intricate, the possibility of misaligning the two halves increase dramatically, rendering a completed heat exchanger useless. Therefore, plate and fin heat exchangers are commonly designed with larger inner partitions, typically resulting in lower performance than extruded aluminum tubes. Another common disadvantage with plate and fin heat exchangers is due to the nature of the design of stacking together plurality of plates without much opening between individual plates. With reduced opening between individual plates, a heat exchange efficiency from a heat exchanger surface to an atmosphere surrounding a heat exchanger media such as air, is often poor, leading to a low efficiency heat exchanger performance.

SUMMARY OF THE INVENTION

The present invention is an enhanced heat exchanger comprising of a plurality of disk type heat exchanger core. A disk type heat exchanger core comprises of plurality of disk units formed by combining two halves of disk members, a first disk member comprising first end of a disk unit, having an inlet formed on first side of the first disk member, and a second disk member comprising the other end of a disk unit, having an outlet formed on a first side of the disk unit. The first disk member and the second disk member are coupled together on respective second side of disks creating a disk unit, while forming a chamber between the first disk member and the second disk member to facilitate flow of heat exchange media herein. Disposed within said disk unit is a heat exchange medium directing member. A heat exchange medium directing member is a material member with first end of the material member end coupled to an inlet of the first disk member. Said first end of material member has a channel cut into a face of the first end of the material member, said channel cut at an angle to facilitate flow of heat exchange media flowing in from the inlet of the first disk member to substantially one side of the chamber. The heat exchange media directed to one side of the chamber by the heat exchange media directing member is then guided towards the other end of the chamber, flow directed by the contour of the chamber wall. The second end of heat exchange media directing member also has a channel cut at an angle on a side typically diagonally opposite from the channel on the first side, to facilitate flow of heat exchange media herein. The heat exchange media that was introduced into the disk unit from the disk inlet, that has then flowed in the disk chamber, following the wall contour of the chamber is then drained out of the disk unit through the outlet formed on the second disk member, directed towards the outlet from the chamber by the heat exchange media directing member disposed within the disk unit. Plurality of said disk units may be coupled together to form a single unitary unit. When one or more disk units are combined to form a single unit, an outlet of a first disk unit is coupled to an inlet of a second disk unit. This arrangement is repeated as needed to obtain a unitary unit with a desired disk unit quantity. One end of said single unitary unit of plurality of disk units may be coupled on one end to a header or a manifold. The other end of said unitary unit of plurality of disk units may be coupled to a header or a manifold member. Plurality of said unitary unit of plurality of disk units may be coupled on first end with a first manifold member, and second end with a second manifold member. One or more baffles may be disposed within first and second manifold to facilitate desired heat exchange media flow pattern.

The present invention is also a method of making a disk type heat exchanger. The method includes the steps of providing a first generally planar material having a tubular member formed on first side of the material, creating an inlet on the material. The method includes a step of shaping said material by cutting out a desired shaped disk member, removing away excess material, creating a first disk member. The method includes the steps of providing a second generally planar material having a tubular member formed on first side of the material, creating an outlet on the material. The method includes the step of shaping said second material by cutting out a desired shaped disk member, removing away excess material, creating a second disk member. The method includes the steps of providing a material, said material having a channel cut at an angle on both ends, creating a heat exchange directing member. The method further includes the steps of disposing said heat exchange medium directing member, first end of the heat exchange medium directing member engaging the inlet of the first disk member, second end of said heat exchange medium directing member engaging the outlet of the second disk member. The method further includes the steps of coupling said first disk member and second disk member on respective second side of disks, creating a chamber between the respective second side of first disk member and the second disk member, forming a disk unit. The method further includes the steps of coupling plurality of said disk units, outlet of a first disk unit engaging an inlet of a second disk unit.

In an embodiment of the present invention, the method includes providing first material and second material that are generally planar sheet material, formed into desired shape by stamping said materials, an inlet of the first material and an outlet of the second material formed by bending said materials on respective first face of materials. The method further includes steps of creating a chamber by plurality of folds on second face of the first material. A first generally annular bend is made generally perpendicular from second face of material, another bend made outwards, generally perpendicular from the first bend, creating a stepped surface from the surface of the second face. In an embodiment of the present invention, said chamber may be created by forming the entire chamber on the first disk member, or creating the chamber by forming the second disk member as well, a complete chamber formed by combining a portion of chamber formed on first disk member and a portion of chamber formed on second disk member.

In another embodiment of the present invention, the first material and second material may be formed by machining said materials, removing away excess material from said materials to form desired shapes.

In an embodiment of the present invention, disk type heat exchangers are provided, for example, for a condenser, evaporator, radiator, etc. The heat exchanger may also be a heater core, intercooler, or an oil cooler for various applications. An advantage of the present invention is that the heat exchange media is introduced into a chamber within individual disk units, thereby increasing the surface area that a heat exchange media gets into contact within a heat exchanger, improving the efficiency of heat exchangers. Conventional heat exchangers, wherein heat exchange media flows in a generally round tube, heat exchange media flows in layers, carrying varying amount of heat within. In such an arrangement, heat exchange media closest to a tube surface may effectively transfer heat from heat exchange media to the tube surface. However, heat exchange media closer to center of the tube may be less efficient at transferring heat on to the tube surface, as heat has to travel through different layers of heat exchange media generally by conduction, in order to reach the tube surface. In comparison, present invention improves heat transfer efficiency of heat exchange media by spreading out the heat exchange media in a chamber, thereby increasing the heat exchange media to heat exchanger surface contact, increasing heat transfer efficiency. A chamber also has an added benefit of reducing the distance heat has to travel within heat exchange media thereby improving heat exchange efficiency, as spreading heat exchange media flat and thin has an added benefit of creating a thinner layer of heat exchange media. Another advantage of the present invention is that a heat exchange media directing member coupled within a disk unit effectively routes heat exchange media to contact heat exchanger surface more effectively. A heat exchange media directing member also has an added benefit of effectively mixing and stirring heat exchange media within a disk unit chamber preventing laminar flow of heat exchange media, thereby increasing heat exchange efficiency. As heat exchange efficiency is improved in the present invention, overall size of heat exchanger may be less compared to a conventional heat exchanger of equal capacity, which in turn provides for a lower overall cost as less raw material and less packaging is necessary. Furthermore, the smaller footprint of the present invention lends itself to be used in applications where space is limited. Yet another advantage of the present invention over a conventional heat exchanger is that a manufacturing process may be simpler because the present invention requires less fragile components and less manufacturing steps. Conventional heat exchangers typically require extensive investment in preparing assembly fixtures, as various components may fall out of place during assembly without assembly fixtures. Furthermore, conventional heat exchangers require new assembly fixtures to be created for each heat exchanger core design change, even if component level parts remain the same. The present invention improves upon conventional heat exchanger manufacturing process, as entire unit may be brazed together, or any portion of the unit may be brazed first, and then additional components may be brazed or soldered together without use of assembly fixtures if necessary, significantly reducing an investment in assembly fixtures.

In another embodiment of the present invention, tube size may vary between disk units. A disk unit size may vary from one disk unit to the other.

In yet another embodiment of the present invention, to further enhance the performance, additional fin material may be added to disk units.

In a further embodiment of the present invention, each media directing member inside a disk unit may be rotated at a predetermined angle from each other.

In another embodiment of the present invention, a disk units may be brazed or soldered together to form a unitary unit.

In yet another embodiment of the present invention, disk units may be made of aluminum, either with cladding or without cladding. Disk units may also be made of stainless steel, copper or other ferrous or non-ferrous materials. Disk units may also be a plastic material or other composite materials. Disk units may also be made of combination of any or all of the mentioned materials.

In another embodiment of the present invention, disk units may be manufactured by stamping, cold forging, or machining.

In a further embodiment of the present invention, disk units may be brazed together or soldered together to form a unitary unit.

Other features and advantages of the present invention will be readily appreciated, as the same becomes better understood after reading the subsequent description taken in conjunction with the accompanied drawings.

DETAILED DESCRIPTION

Figure 1A:
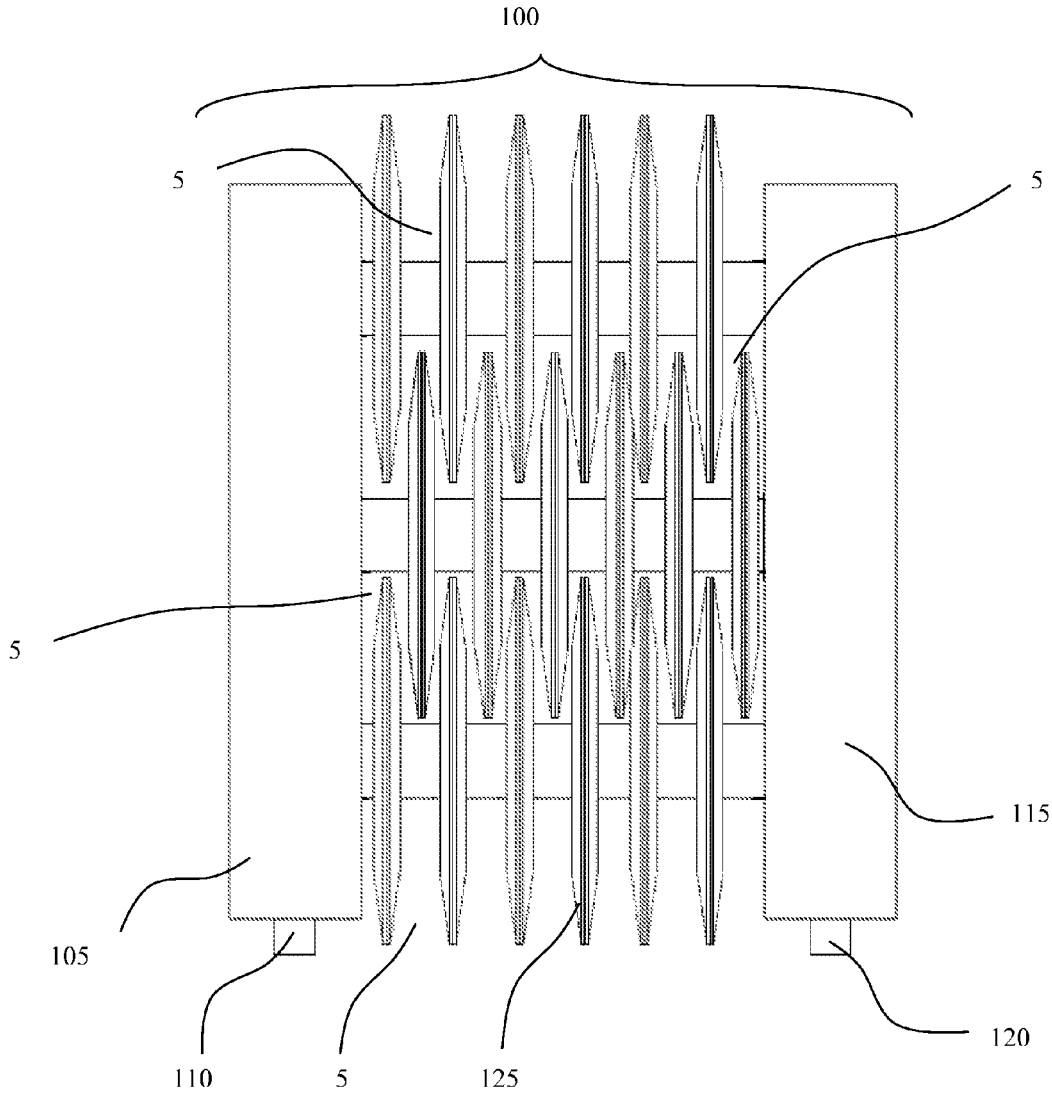
FIG. 1A is a frontal view of a disk type heat exchanger according to embodiments of the present invention.
Figure 2A:
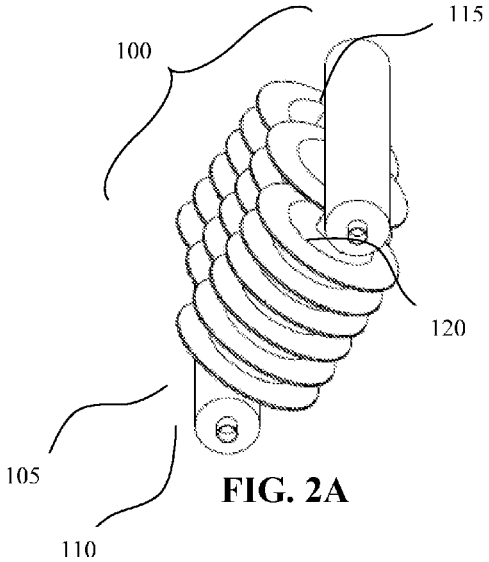
FIG. 2A is a perspective view of a disk type heat exchanger according to embodiments of the present invention.
Figure 2B:
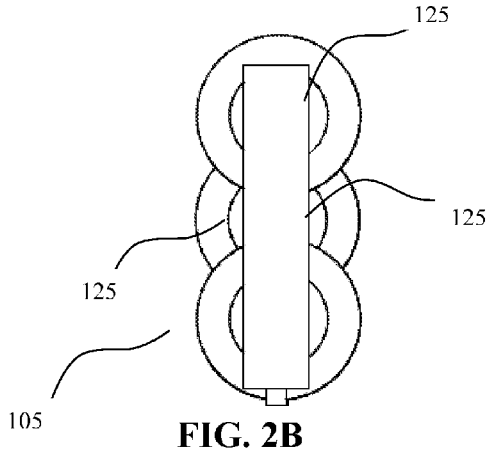
FIG. 2B is a side view of a disk type heat exchanger according to embodiments of the present invention.
Figure 2C:
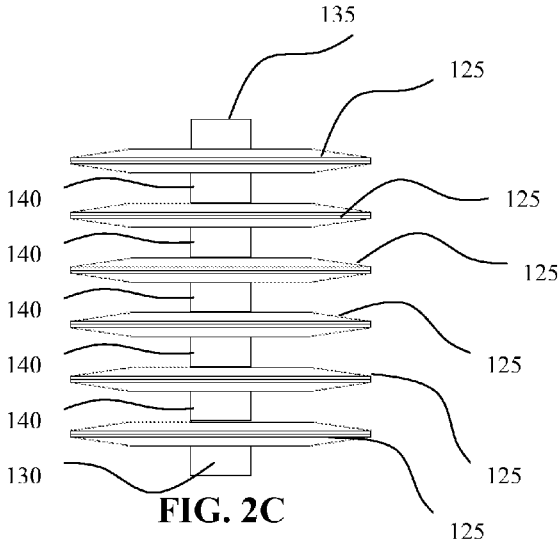
FIG. 2C is a side view of a plurality of disk units according to an embodiment of the present invention.
Figure 2D:
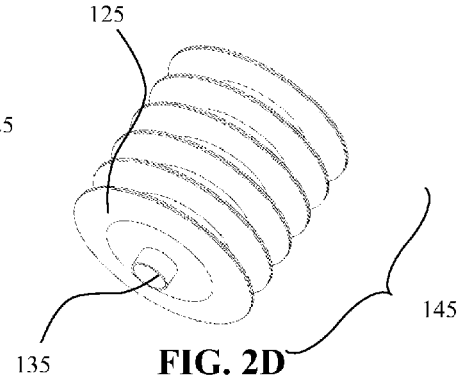
FIG. 2D is a perspective view of a plurality of disk units according to an embodiment of the present invention.

Referring to the drawings and in particular FIG. 1A, an embodiment of a disk type heat exchanger 100 is shown. The heat exchanger 100 comprises of plurality of disk units 125. A quantity of disk units 125 are coupled together to form a unitary unit (row) of a plurality of disk units 145 (see FIG. 20). Each row of the plurality of disk units 145 may be coupled by two manifolds 105 and 115, said manifolds having a plurality of holes to couple to ends of the rows of disk units 145. Manifolds 105 and 115 are typically arranged in a parallel fashion, set apart to a predetermined length to couple first end 130 to first manifold 105, and second end 135 to second manifold 115 (see FIGS. 1A and 2C). Manifolds 105 and 115 facilitate flow of heat exchange media 50 between individual rows of plurality of disk units 145. More than one unit of plurality of disk units 145 may be coupled to manifolds 105 and 115 to obtain desired heat exchange performance. Generally speaking, the more rows of the plurality of disk units 145, the higher the performance of a heat exchanger. Manifold 105 may have an inlet 110 to introduce heat exchange media 50 to a heat exchanger unit 100. Heat exchange media 50 upon flowing in through a heat exchanger 100 may exit through outlet 120. Manifolds may have one or more baffles to obtain a desired flow pattern between individual rows of the plurality of disk unit 145. Throughout the transport of the heat exchange media 50 through the heat exchanger 100, heat from the heat exchange media 50 is transferred to the material comprising individual disk units 125. The heat from the heat exchange media 50 that has then been absorbed by a material comprising individual disk units 125 is transferred to a heat exchanger surrounding media 5 outside of the heat exchanger 100. Heat exchanger surrounding media 5 is heat exchange media that may be generally the same composition as heat exchange media 50, or in other embodiments the heat exchanger surrounding media 5 may be of different composition than that of heat exchange media 50. Composition of heat exchange media 50 and heat exchanger surrounding media 5 varies based on an application of a heat exchanger. The composition may be a combination of any and all known heat carrying heat exchange media. Although not meant to be limiting, common heat exchange media known in the art includes various refrigerants (i.e., R-134A), carbon dioxide, butane, oils, gases (e.g., air), water, and a mixture of water and other coolants (e.g. ethylene glycol).

Figure 3A:
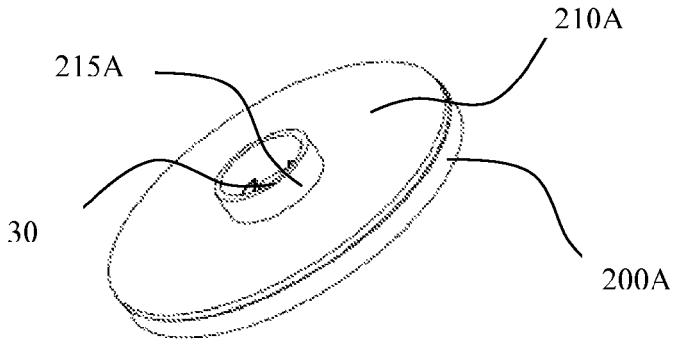
FIG. 3A is a perspective view of a disk unit according to an embodiment of the present invention.
Figure 3B:
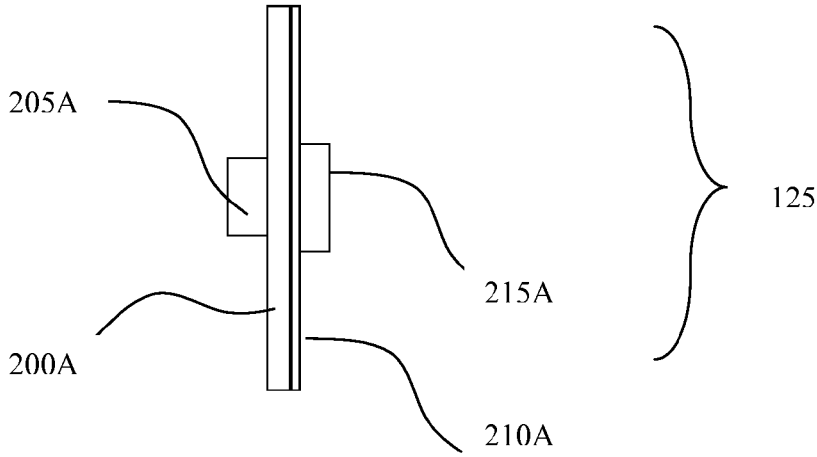
FIG. 3B is a side view of a disk unit according to an embodiment of the present invention.
Figure 3C:
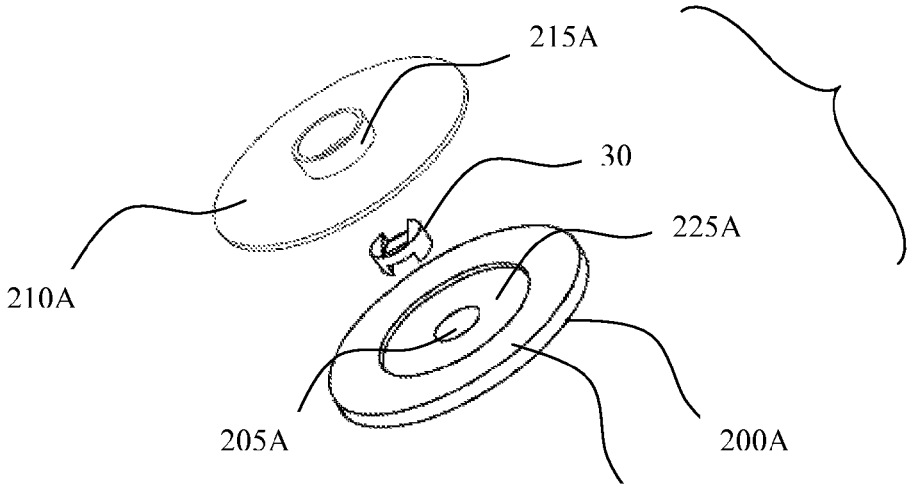
FIG. 3C is an exploded view of a disk unit according to an embodiment of the present invention.
Figure 5A:
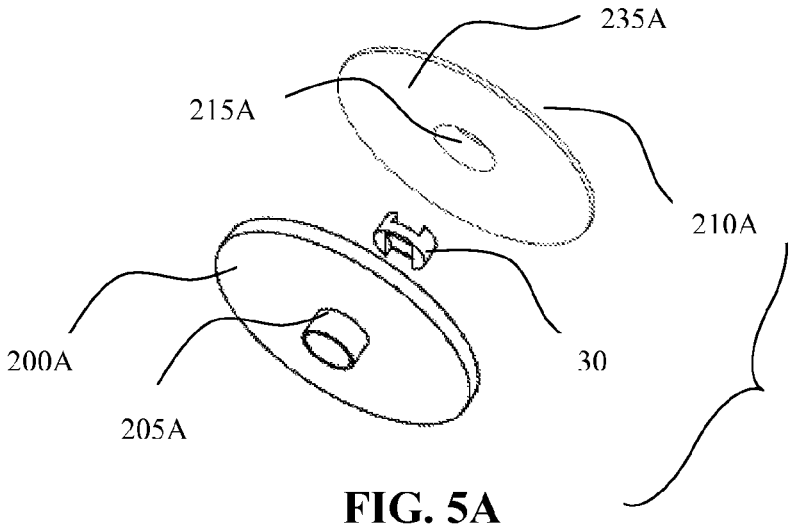
FIG. 5A is an exploded view of a disk unit according to embodiments of the present invention.
Figure 5B:
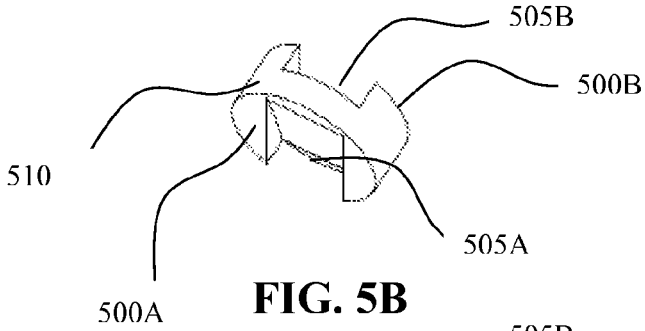
FIG. 5B is a perspective view of a heat exchange media directing member according to an embodiment of the present invention.
Figure 5C:
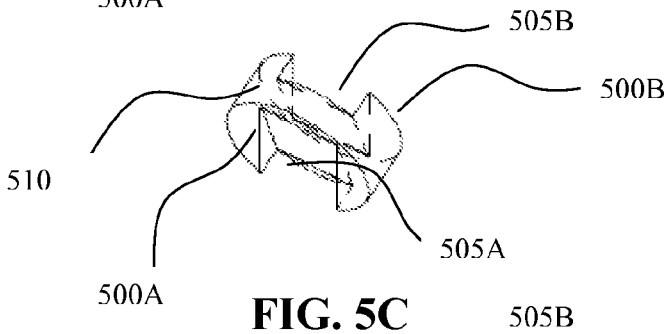
FIG. 5C is yet another perspective view of a heat exchange media directing member.
Figure 5D:
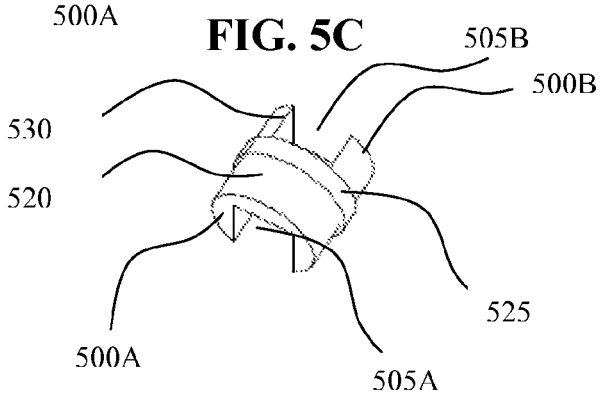
FIG. 5D is a perspective view of another embodiment of a heat exchange media directing member.

Referring to FIG. 3B, disk units 125 comprises a first disk member 200A, an inlet 205A formed as a tubular member on a first side of the first disk member, a second disk member 210A having outlet 215A formed as a tubular member on a first side of the second disk member. Said first disk member 200A and second disk member 210A are coupled together on respective second sides of the disk members, the outer periphery of the first disk member 220A engaging the second side of the second disk member 235A, forming a disk unit, while creating a chamber 225A between the respective second sides of the first disk member and the second disk member (see FIG. 3C). Referring to FIG. 3C, a heat exchange medium directing member 30 is disposed within said disk unit, a first end of the heat exchange medium directing member 500A (see FIG. 5B) engaging the inlet of the first disk member 205A (see FIGS. 3C, 5A). Said first end 500A of heat exchange medium directing member 30 has a channel 505A cut at an angle (see FIGS. 5B-5D). Channel 505A directs heat exchange media 50 flowing in from the inlet 205A of the first disk member 200A to chamber 225A, created between the second side of the first disk member 200A and the second side of the second disk member 210A. A second side of the heat exchange medium directing member 500B (see FIG. 5B) engages the outlet of the second disk member 215A (see FIGS. 3C, 5A). Said second end 500B of heat exchange medium directing member 30 has a channel 505B cut at an angle (see FIGS. 5B-5D). Channel 505B directs heat exchange media 50 out of the chamber 225A through the outlet 215A of the second disk member. Side wall 510 engages the inlet 205A of the first disk member 200A as well as the outlet 215A of the second disk member 210A, so that the heat exchange media 50 flows through only the channel 505A, the chamber 225A, and the channel 505B.

Figure 1B:
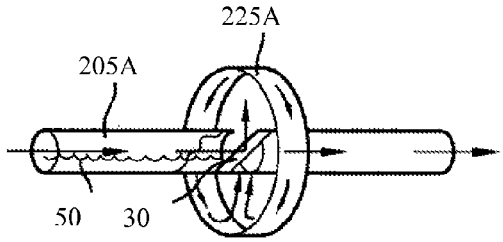
FIG. 1B is a perspective view of a disk unit illustrating a media flow regime.

FIG. 1B illustrates a flow pattern of heat exchange media 50 within a typical embodiment of a disk unit 125. A heat exchange media 50 flows in through an inlet 205A of a disk 200A. Heat exchange media 50 is directed towards substantially one end of a chamber 225A by a heat exchange media directing member 30, specifically by the channel 505A therein. The heat exchange media follows a contour of an inner wall of the chamber 225A until the heat exchange media 50 again reaches the medium directing member 30, specifically the channel 505B therein. At this point, heat exchange media 50 is drained out of disk unit 125 through outlet 215A, the flow being directed by the channel 505B.

Figure 4A:
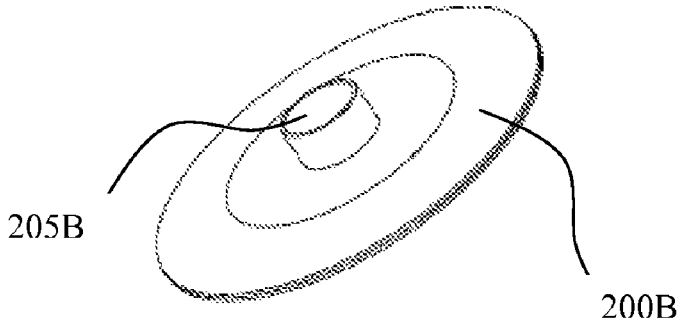
FIG. 4A is a perspective view of another embodiment of a disk unit according to the present invention.
Figure 4B:
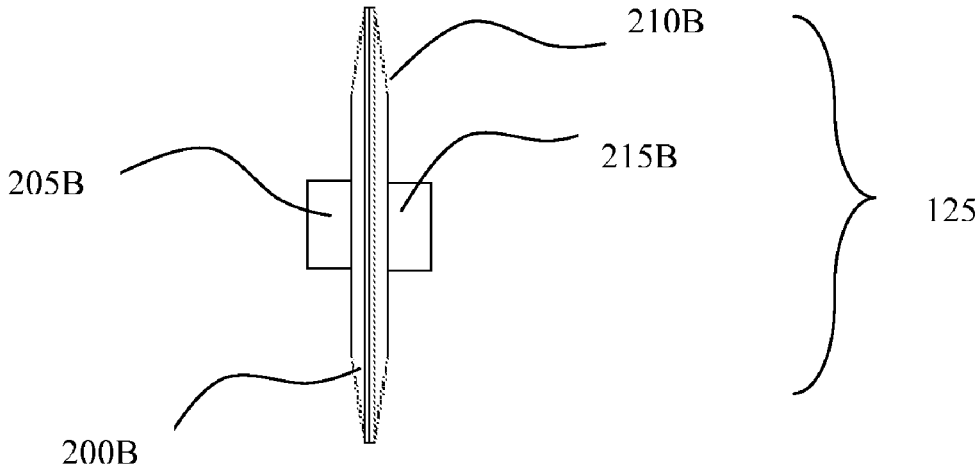
FIG. 4B is a side view of an embodiment of a disk unit according to the present invention.
Figure 4C:
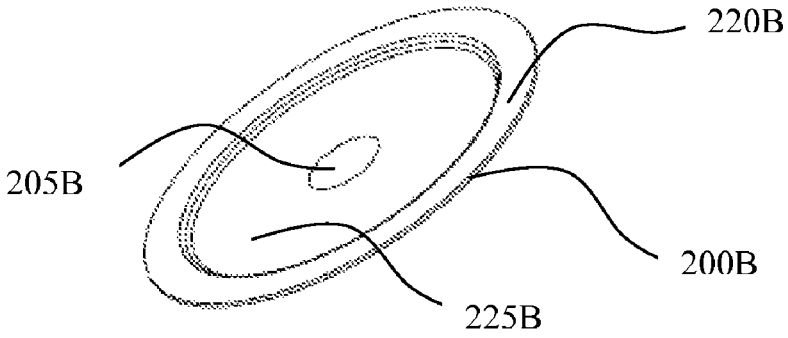
FIG. 4C is a perspective view of second side of an embodiment of a disk unit according to the present invention.

In another embodiment of a disk unit, referring to FIG. 4B, disk units 125 comprises a first disk member 200B, an inlet 205B formed as a tubular member on a first side of a disk, a second disk member 210B having outlet 215B formed as a tubular member on a first side of a disk. Said first disk member 200B and second disk member 210B are coupled together on respective second sides of the disks, the outer periphery of the first disk member 220B engaging a second side of the second disk member outer periphery 220B, forming a disk unit, creating a chamber by combining two halves of a chamber 225B from the first disk member and a chamber 225B from the second disk member. A heat exchange medium directing member 30 is disposed within said disk unit, a first end of the heat exchange medium directing member 500A engaging the inlet of the first disk member 205B. Said first end of the heat exchange medium directing member 30 has a channel 505A cut at an angle. The channel 505A directs the heat exchange media 50 flowing in from the inlet 205B of the first disk member 200B to a chamber created by combining two halves of chambers 225B from the first disk member and the second disk member. A complete chamber is created by combining two chambers 225B from the first disk member and the second disk member. A second side of the heat exchange medium directing member 500B engages the outlet of the second disk member 215B. Said second end 5008 of heat exchange medium directing member 30 has a channel 505B cut at an angle. The channel 505B directs the heat exchange media 50 out of the chamber through the outlet 215B of the second disk member 210B. Side wall 510 of the medium directing member 30 engages the inlet 205B of the first disk member 200B as well as the outlet 2158 of the second disk member 210B, so that the heat exchange media 50 flows through only channel 505B, the chamber and the channel 505B.

Referring to FIGS. 2C, 2D and 3A-3C, when a plurality of disk units are combined together to form a unitary unit 145, disk units 125 may be coupled together by coupling a second inlet 205A and a first outlet 215A, forming a tubular unit 140. To facilitate ease of assembly, the inlet 205A may be manufactured with an outside diameter that is substantially the same as an inside diameter of the outlet 215A. When more than one disk unit 125 is coupled together, the inlet 205A may be disposed in outlet 215A, forming a tubular unit 140. Conversely, the inlet 205A may be manufactured with an inside diameter that is substantially the same as outside diameter of the outlet 215A. When more than one disk unit 125 is coupled together, the outlet 215A may be coupled to the inlet 205A. In yet another embodiment of the present invention, inlet 205A and outlet 215B may be of substantially the same diameter, with the plurality of disk units attached in a butt-joint method.

Many modifications and variations of the present invention are possible in light of the above teachings. Therefore, within the scope of the appended claims, the present invention may be practiced other than as specifically described.

What is claimed:

1. A disk type heat exchanging device comprising:

a first disk member having an inlet formed as a tubular member on a first side of the first disk member;

a second disk member having an outlet formed as a tubular member on a first side of the second disk member, an outer periphery of the second sides of the first and second disk members engaging each other to form a disk unit, said disk unit having a chamber to facilitate flow of heat exchange media therein; and a heat exchange medium directing member disposed within said disk unit, a first end of the heat exchange medium directing member engaging the inlet of the first disk member, said first end having a first channel formed at an angle to direct heat exchange media flowing in from the inlet of the first disk member to the chamber, a second end of said heat exchange medium directing member engaging the outlet of the second disk member, said second end of the heat exchange medium directing member having a second channel formed at an angle to direct heat exchange media out of the chamber through the outlet of the second disk member, the second channel being disposed in a first side portion of the heat exchange directing member which is generally diagonally opposite from a second portion of the heat exchange medium directing member in which the first channel is disposed, wherein a plurality of said disk units are coupled together such that the outlet of a first disk unit provides the heat exchange medium to the inlet of an adjacent second disk unit.

2. The heat exchanging device according to claim 1, wherein said heat exchange medium directing member and a chamber contour create at least two distinct flow patterns for the heat exchange media within the chamber.

3. The heat exchanging device according to claim 1, further including two manifolds with a plurality of holes, said manifolds arranged in a parallel fashion, set apart to a predetermined length to couple to free inlets or free outlets of the disk units.

4. The heat exchanging device according to claim 3, wherein the manifolds contain one or more baffles to direct flow of the heat exchange media within the manifolds.

5. The heat exchanging device according to claim 3, wherein a first manifold has a first hole functioning as an inlet coupled to the free outlet of a first disk unit, and a second manifold has a second hole functioning as an outlet coupled to the free inlet of a second disk unit to facilitate flow of the heat exchange media.

6. The heat exchanging device according to claim 3, wherein the first manifold has a first hole functioning as an inlet and a second hole functioning as an outlet to facilitate flow of the heat exchange media.

7. The heat exchanging device according to claim 1, wherein the disk members are made of one or more aluminum alloys, brazed together to form the disk unit.

8. The heat exchanging device according to claim 1, wherein the disk members are made of cladded material, brazed together to form the disk unit.

9. The heat exchanging device according to claim 1, wherein the tubular member on the first side of the first disk member is oval or a flat tubular shape.

10. A disk type heat exchanging device comprising:

a first disk member having an inlet formed as a tubular member on a first side of the first disk member;

a second disk member having an outlet formed as a tubular member on a first side of the second disk member, an outer periphery of the second sides of the first and second disk members engaging each other to form a disk unit, said disk unit having a chamber to facilitate flow of heat exchange media therein; and a heat exchange medium directing member disposed within said disk unit, a first end of the heat exchange medium directing member engaging the inlet of the first disk member, said first end having a first channel formed at an angle and having a contour, except at the first channel, to match a contour of the inlet so that the heat exchange media flowing in from the inlet of the first disk member is directed to the chamber, a second end of said heat exchange medium directing member engaging the outlet of the second disk member, said second end of the heat exchange medium directing member having a second channel formed at an angle and having a contour, except at the second channel, to match a contour of the outlet so that the heat exchange media is directed out of the chamber through the outlet of the second disk member, the second channel being disposed in a first side portion of the heat exchange directing member which is generally diagonally opposite from a second side portion of the heat exchange directing member in which the first channel is disposed, wherein a plurality of said disk units are coupled together such that the outlet of a first disk unit provides the heat exchange medium to the inlet of an adjacent second disk unit.

11. The heat exchanging device according to claim 10, wherein the channels of the heat exchanger medium directing member on the ends of the medium directing members are set at an angle greater than 20 degrees but less than 90 degrees.

12. The heat exchanging device according to claim 10, wherein the medium directing member substantially prevents the media flowing into the inlet of the first disk member to continue its initial flow directional, causing the heat exchange media to substantially alter flow direction within the disk chamber, prior to substantially returning the flow direction to the initial flow direction when the heat exchange media reaches the outlet of the second disk member.

13. A method of making a heat exchanger comprising:

providing a first generally planar material having a tubular member formed on a first side of said first material, forming an inlet;

cutting a desired shaped disk member out of said first material, forming a first disk member;

providing a second generally planar material having a tubular member formed on a first side of said second material, forming an outlet;

cutting a desired shaped disk member out of said second material, forming a second disk member;

forming a heat exchange directing member having a first channel cut at an angle on a first end and a second channel cut at an angle on an opposite end;

disposing said heat exchange medium directing member such that the first end of said heat exchange medium directing member engages the inlet of the first disk member, and the second end of said heat exchange medium directing member engages the outlet of the second disk member;

coupling together said first disk member and second disk member on respective second sides of the disk members, leaving a chamber between the respective second sides of the first disk member and the second disk member to form a disk unit; and coupling together a plurality of said disk units by engaging the outlet of a first disk unit with the inlet of a second disk unit.

14. The method according to claim 13 wherein the first generally planar material and the second generally planar material are generally planar sheet material, formed into desired shape by stamping said material, the inlet of first material and the outlet of second material being formed by bending said materials.

15. The method according to claim 13 wherein the first generally planar material and the second generally planar material are formed into desired shape by machining said materials.

16. The method according to claim 13 wherein the chamber is created by a plurality of folds, a first generally annular bend made generally perpendicular from a second side of the material, another bend made outwards, away from the center of a disk member, generally perpendicular from the first bend, creating a stepped surface on the second side of the disk member.

17. The method according to claim 13 wherein the chamber is created by machining, a desired chamber being formed by removing material away from a face of the material.

18. The method according to claim 13 wherein the first disk member and the second disk member are coupled together by crimping an outer periphery of the first disk member onto the second disk member.

* * * * *